United States Patent [19]

Glucksman

[11] 4,090,061

[45] May 16, 1978

[54] ELECTRIC AIR-HEATER UNIT UTILIZING A CENTRIFUGAL IMPELLER

[76] Inventor: Dov Zeev Glucksman, 43 Norwood Ave., Newton, Mass. 02159

[21] Appl. No.: 662,807

[22] Filed: Mar. 1, 1976

[30] Foreign Application Priority Data

Mar. 9, 1975 Israel ..... 46779

[51] Int. Cl.[2] ..... H05B 1/00; F24H 3/04; A45D 20/10

[52] U.S. Cl. ..... 219/369; 34/97; 219/368; 219/373; 219/374; 219/375; 338/58; 338/294; 338/333

[58] Field of Search ..... 219/366, 368, 369–371, 219/374–376, 381, 382, 532; 338/53, 55, 57, 56, 58, 206–208, 279–295, 321, 333, 334; 34/96–101, 243 R; 132/9, 11 R

[56] References Cited

U.S. PATENT DOCUMENTS

| | | | |
|---|---|---|---|
| 1,928,142 | 9/1933 | Trent et al. | 338/281 X |
| 1,975,410 | 10/1934 | Simpson | 338/282 X |
| 2,102,302 | 12/1937 | Arnold | 338/284 X |
| 2,133,188 | 10/1938 | Conforti | 219/370 X |
| 2,424,780 | 7/1947 | Trent | 338/321 |
| 2,474,664 | 6/1949 | Grabeau | 219/374 |
| 2,553,875 | 5/1951 | Shaw | 338/284 X |
| 2,702,332 | 2/1955 | DuBois | 338/278 X |
| 2,790,889 | 4/1957 | Hynes | 338/280 X |
| 3,211,891 | 10/1965 | Kendall | 338/57 X |

*Primary Examiner*—A. Bartis
*Attorney, Agent, or Firm*—John S. Roberts, Jr.

[57] ABSTRACT

An air heating unit comprises a blower casing, a centrifugal impeller and a heating element in the shape of a cylindrical cage of longitudinal guide vanes fastened to the wall of the casing. The guide vanes are made from an electric resistance alloy in sheet form in the shape of uniform strips of a length conforming to the width of the impeller, all vanes being connected at their ends by conductive bridging pieces jointing the alternate ends of each two proximate vanes, thus forming a resister in zigzag pattern provided with terminals for energizing it. The vanes and the bridging pieces may form part of a single rectangular sheet rolled up to form the cylindrical casing and provided with alternate transverse cuts along both edges which stop short of the bridging pieces. The strips between the bridging pieces are bent or curved outwardly from the sheet at a desired angle.

6 Claims, 12 Drawing Figures

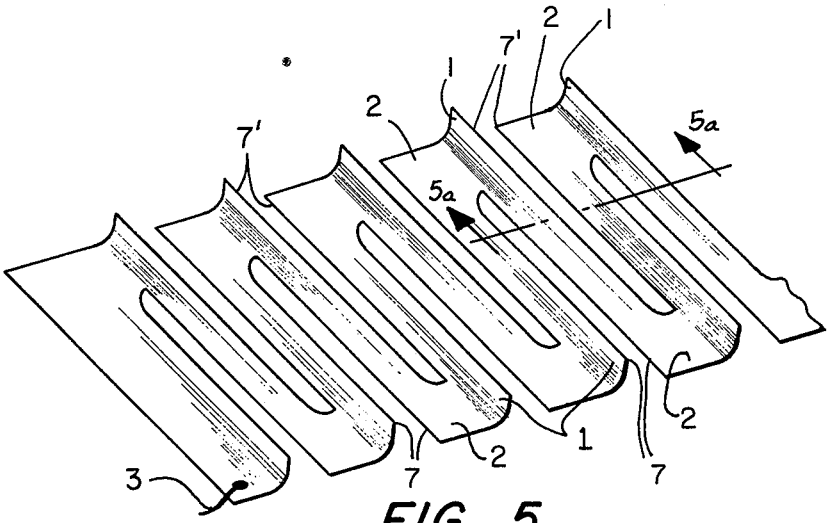
FIG. 5
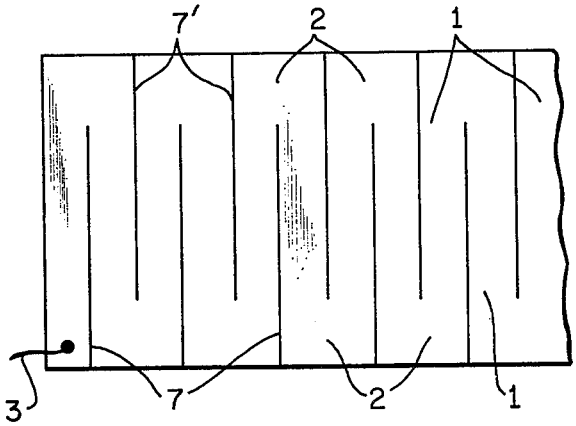
FIG. 6
FIG. 7
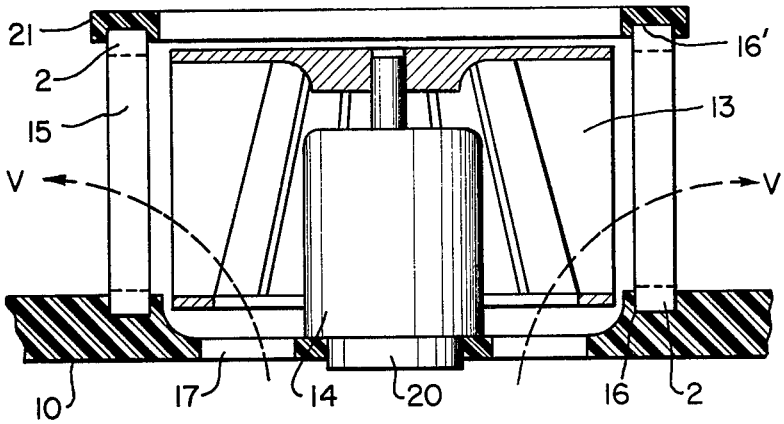

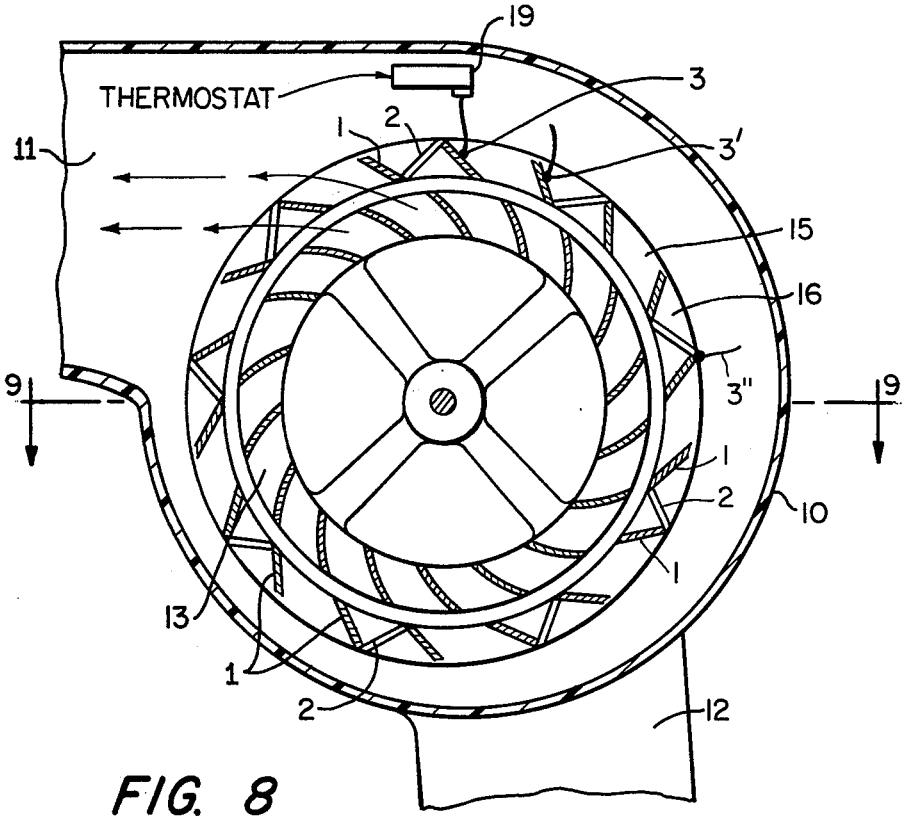
FIG. 8
FIG. 9
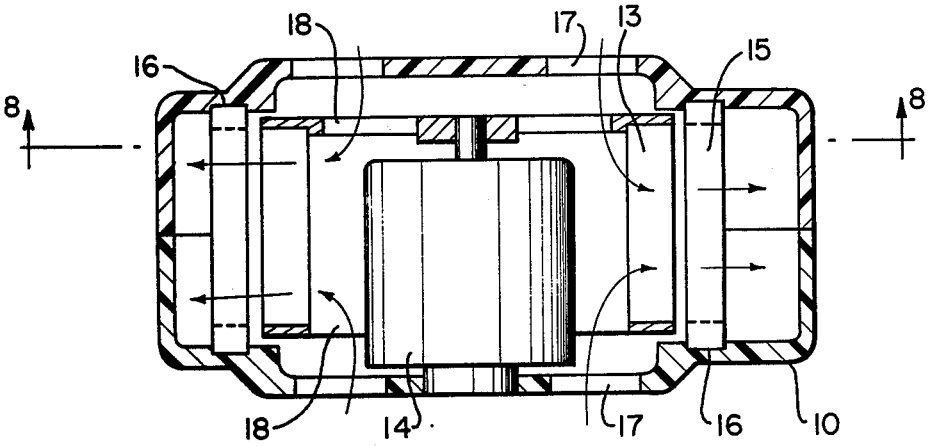

ELECTRIC AIR-HEATER UNIT UTILIZING A CENTRIFUGAL IMPELLER

BACKGROUND OF THE INVENTION

Most centrifugal blowers possess a spiral housing which serves to guide the air emerging from the impeller in a substantially tangential direction, to one common discharge opening and to partly convert the velocity head to pressure head by gradually and smoothly reducing the air velocity on its way along the spiral. In high-velocity and high-pressure blowers this process is aided by means of a plurality of preferably curved guide vanes placed around the impeller in the way of the air emerging therefrom, in such a manner as to deflect it and to reduce its velocity. The use of guide vanes results in a higher overall efficiency and smaller dimensions of the spiral casing. Guide vanes are generally not used with smaller blowers, since the small saving in energy does not warrant their additional cost.

On the other hand, the heating of air in domestic appliances, such as room heaters, hair dryers, laundry dryers and others, is generally done by electric resisters placed in the air stream issuing from a centrifugal blower.

In order to save space and to increase heat transfer by turbulance it has been proposed to place electric resistors in the shape of coils or ribbons into the blower casing proper, either along the scroll or as annular elements surrounding the impeller or rotor. Obviously, these resistors disturb and obstruct the otherwise smooth air-flow, while consuming additional energy, and in order to counteract this effect and to reduce the air velocity the scroll dimensions are frequently enlarged; however, this results in a detrimental increase of the overall dimensions of the appliance.

In view of these drawbacks it is the object of the present invention to provide heating elements in a shape suitable for preventing disturbance of the air flow and, in addition, to arrange these in the shape of flow-guide vanes around the circumference of the impeller, with a view to improve the flow and the overall efficiency of the appliance.

SUMMARY OF THE INVENTION

The invention consists of an electric heating element in use with a device for heating and delivering air, in the shape of a stationary cylindrical cage of longitudinal guide vanes with their leading edges in parallel with the axis of the cage which is positioned so as to enclose a bladed, centrifugal impeller in peripheral and concentric alignment, wherein each vane forms a flat or curved, ribbon-shaped resistor of an electrical resistance alloy adapted to be electrically energized to provide a means for heating the air delivered by the impeller, and angularly positioned to guide the air flow in a predetermined direction.

In a preferred embodiment of the invention the centrifugal impeller and the cage of guide vanes forming the heating element are — partly or completely — enclosed in casing means provided with openings for the inlet and discharge of air, which holds and supports at least one end of the cylindrical cage in concentric alignment with the impeller.

The guide vanes of the cage, preferably made from an electrical resistance alloy in sheet form, are in the shape of flat or curved strips of a length substantially commensurate with the width of the impeller and are held in a predetermined spaced relationship by conductive bridging pieces jointing the alternate ends of each two proximate vanes of the cage, so as to create a resistor circuit in zigzag-pattern, at least two electrical terminals being provided on the said cage for carrying electric current through the circuit.

In a preferred embodiment of the invention the cage is formed from a rectangular sheet of material having a width equal to that of the flat or curved strips forming the vanes and a length equal to the combined width of all vanes and of all bridging pieces incorporated in the cage, by first cutting out of the sheet in staggered paralled alignment narrow rectangles, in such a manner that the remaining material is in the form of parallel vanes connected at alternate ends by bridging pieces, secondly folding the cut-out sheet along lines defining the borders between vanes and bridges, in alternate sense of direction, so as to align every vane at the same predetermined angle with the plane of the sheet, thirdly bending the sheet to form a cylindrical cage and finally inserting this cage into a suitably shaped space in the blower housing.

In a cage cut out from a rectangular sheet, the width of the bridging pieces measured in parallel to the vane edge is preferably larger than the width of the vanes, so as to offer a larger cross section to the electric current and to generate less heat in these portions.

With a view to keep the width of the blower casing to minimum the thickness of the bridge material can be increased while reducing their width in comparison to that of the vanes; this can be attained by producing separate vanes from straight or curved rectangular strips and connecting their alernate ends by separate rectangular, suitably bent bridges of a thicker sheet material, the jointing of each bridge to the respective vane being carried out by such known methods as soldering, brazing, spot welding or other current-conducting means.

BRIEF DESCRIPTION OF THE DRAWINGS

FIG. 5 shows a flat portion of another embodiment of a resistor cage, made from a rectangular sheet of material.

FIG. 6 shows the portion of the cage illustrated in FIG. 5, before bending the vanes, FIG. 7 is a cross section through a centrifugal, motor-driven impeller enclosed in a cage of resistor guide vanes, FIG. 8 is a cross section through a hair dryer provided with a resistor cage according to the invention taken along line 8—8 of FIG. 9, FIG. 9 is a section of the hair dryer of FIG. 8 along 9—9.

DESCRIPTION OF PREFERRED EMBODIMENT

Figure 1:
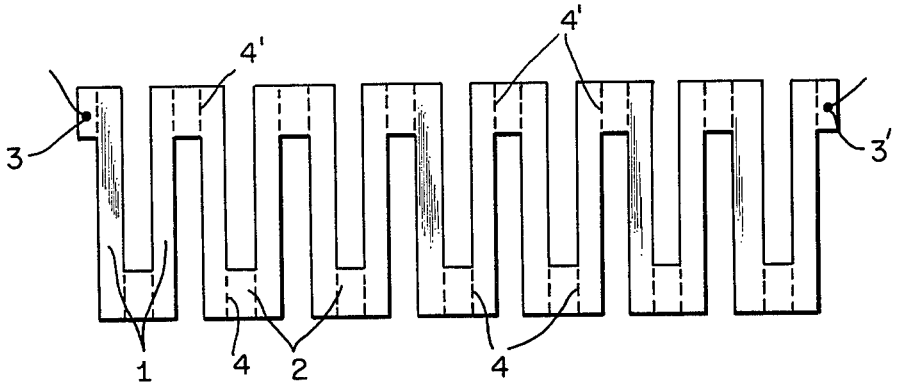
FIG. 1 is a plan view of a sheet of resistor material after cutting, but prior to folding.

With preference to FIG. 1 a resistor cage is made from a rectangular sheet of any electrical resistance alloy known to the art. Its length is so as to contain a suitable number of rectangular vanes 1 connected at alternate ends by rectangular, short bridging pieces 2 being of greater width than the vanes 1 so as to offer less resistance to the electric current. These sheets are industrially manufactured by feeding a roll of strip material to an automatic punching press and by subsequently cutting the punched strip into pieces of the required length. Two terminals 3 and 3' are affixed to the ends of the two outermost vanes.

Figure 2:
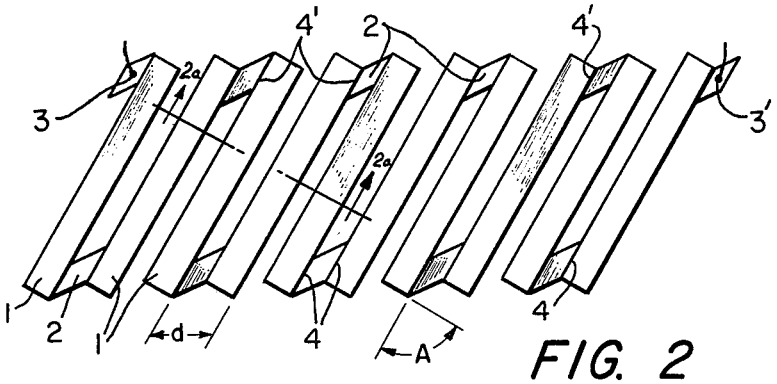
FIG. 2 is an isometric view of the cut-out sheet shown in FIG. 1, after folding.
Figure 2A:
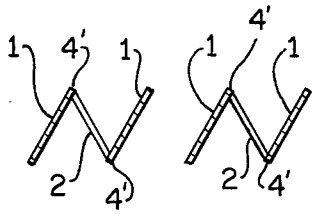
FIG. 2A is a cross section along lines 2A—2A through the folded, cut-out metal sheet shown in FIG. 2.

FIGS. 2 and 2A show the same strip after having been folded along the lines 4 and 4' as indicated in broken lines in FIG. 1. The vanes now form an angle A with the plane of the sheet, before its bending to a cylindrical cage, while they are spaced at a distance determined by the length of the bridging pieces.

Figure 3:
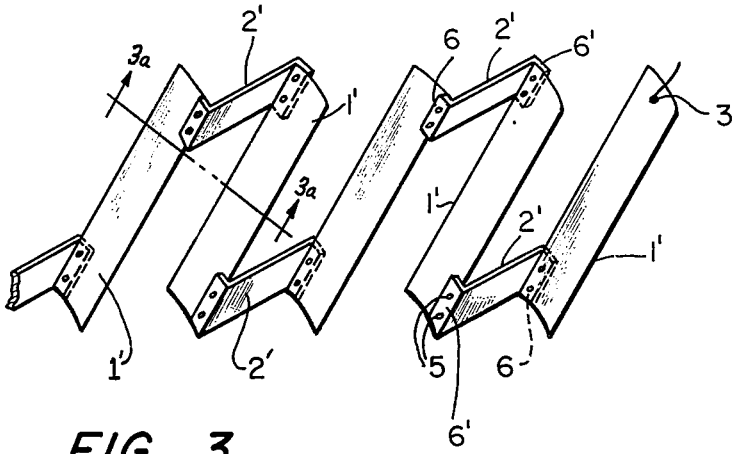
FIG. 3 is an isometric view of a portion of a cage made by welding.
Figure 3A:
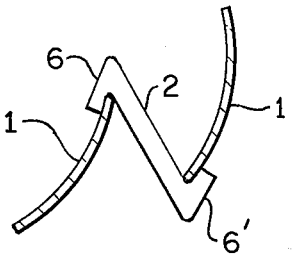
FIG. 3A is a cross section along lines 3A—3A through the welded cage shown in FIG. 3.

Another way of manufacture is shown in FIGS. 3 and 3A wherein the cage — before bending — possesses curved vanes 1' which are jointed to each other by pre-bent bridges 2', by means of spot welds 5. The material of which the bridges are made is considerably thicker than the material for the vanes, permitting the use of narrow bridges of a large cross section and, consequently, a low electric resistance. As can be seen, the bridges have their ends 6 and 6' bent over to the angle of the vane, before their jointing by spot welding, however the folding could also be carried out in special folding dies, after welding.

Figure 4:
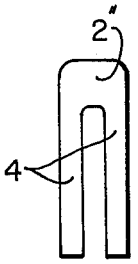
FIG. 4 is a plan view of a portion of a sheet of resistor material similar to that illustrated in FIG. 1, but with rounded corners.

FIG. 4 shows a modification of the punched sheet illustrated in FIG. 1, wherein all corners are rounded. This shape is advantageous regarding internal stresses and results in a more equal distribution of the electric current; in addition, punches and dies with rounded corners experience less wear and tear.

Figure 5A:
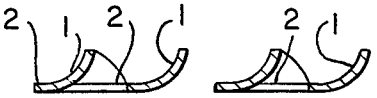
FIG. 5A is a cross section along lines 5A—5A through the resistor cage shown in FIG. 5.

FIGS. 5, and 5A, and 6 show another embodiment of the resistor cage, in stretched-out form before being rolled up into a cylinder. It is made (FIG. 6) from a rectangular sheet of a resistance alloy by making alternate, transverse cuts 7 and 7' reaching from either long side of the sheet to a distance from the opposite side equal to the required width of the bridging pieces 2. The vanes 1, thus formed, are bent into curved shape extending from their free end to the end of the cuts 7 and 7', whereby the previously adjacent edges of each cut are separated from each other, and a zigzag-shaped resistor is formed similar to that shown in FIGS. 1 to 3. It can be clearly seen that the width of the bridging pieces is greater than that of the vanes, resulting in lower current density and lower temperature of these portions. A terminal 3 is affixed to the left corner of the sheet, the second terminal being in the opposite corner of the sheet which is not shown in this figure.

FIG. 7 shows a combination of a resistor cage 15 with a motor-driven centrifugal impeller 13 mounted on a base-plate 10 of an appliance. Herin the centrifugal impeller is mounted on the shaft of an electric motor 14 which is attached to the base plate 10 by a cylindrical base 20. The base plate is perforated by air-inlet openings 17 arranged around the boss 20 and is provided, on the side facing the electric motor, with a circular groove 16 destined to receive and to support the lower end of the cage 15, co-axially with, and equidistantly spaced from the impeller 13. The upper end of the cage is held in circular position in a groove 16' provided in a flat ring 21, which latter may be additionally fastened to the base plate by known means.

Air enters the impeller through the inlet openings 17 and is expelled to the outside, in the direction indicated by arrows V, passing between the vanes 1 of the cage which heat the air and direct the flow in a predetermined radial or tangential direction.

An extension of the base plate in the shape of a housing or casing may by provided for collecting the air issuing from the vanes and for directing it to an outlet opening.

An arrangement of this kind is shown in FIGS. 8 and 9 illustrating a hair dryer which comprises a spiral housing 10, an outlet opening in the shape of a nozzle 11 and a grip 12. A bladed impeller 13 is fastened to the shaft of an internal motor 14 which is attached to a side wall of the blower housing. A stationary resistor cage 15 comprising vanes 1 and bridging pieces 2 is inserted into two opposed circular grooves 16 provided in the side walls of the housing which is bisected and jointed along the centre line as shown in FIG. 9.

Air enters the housing through openings 17 in the side walls and the impeller through openings 18, is accelerated by the rotating impeller and expelled in substantially tangential direction into the resistor cage where the vanes are instrumental in reducing the air velocity and to partly convert it into pressure. An electric current, controlled by a thermostat 19 passes through the cage between the terminals 3 and 3', heating the vanes 1 and transferring the heat to the air transversing them.

The shape and size of the guide vanes, the cage, the vane angle and the electric resistance will be chosen in accordance with the application of the unit. Their manufacture and form may be variously modified by a person skilled in the art, without, however, deviating from the spirit of the invention and the scope of the appended claims.

It is, for instance, proposed to make the cage as shown in FIG. 3, from one punched sheet material similar to that illustrated in FIG. 1, by suitably bending the vanes into curved shape while folding the sheet, by means of a combined punch and die.

The manufacture of the cage illustrated in FIGS. 1 and 2, may also be carried out in a continuous process by a multiple punch and die press, or by etching. The fixation of the cage in the blower housing is not necessariy by way of circular grooves, but may be done by inserting the vanes into the free spaces left between projecting lugs on the inside of the blower housing walls, by which method a more accurate spacing of the vanes can be obtained.

The outer surface of the cage may be electrically insulated in a suitable manner by one of the methods known to the art; however in many instances they can be left blank, similarly to the wire coils presently used as heating elements in domestic appliances, which are protected against direct human contact.

In the foregoing two terminals (3, 3') only have been shown and described in connection with the resistor cage; it is, however, proposed to provide three or more terminals along the circumference of the cage as shown at 3, 3' and 3'' in FIG. 8 with a view to varying the cage resistance and thus changing the heating performance of the appliance by connecting different terminals to the current source.

I claim:

1. An apparatus for heating and delivering air comprising a bladed, centrifugal impeller rotatable about an axis and an electric heating element in the shape of a stationary cylindrical cage of spaced longitudinal air guide vanes made of an electric resistance alloy, said cage being substantially coextensive in height with the width of the impeller and being positioned so as to surround said impeller in peripheral, spaced concentric alignment, said guide vanes being in the shape of strips of uniform width extending substantially parallel to the longitudinal axis of the cage, the surface of each strip being inclined in respect of the ideal cylindrical surface of the cage, the inclination being uniform in degree and direction for all strips of the cage, means being provided for electrically energizing the said guide vanes for heating said vanes to a temperature adequate for heating the air passing through the impeller and the guide vanes and means for rotating the impeller to cause air to flow through the air guide vanes of the cage.

2. An apparatus for heating and delivering air as defined in claim 1, wherein said centrifugal impeller and said cylindrical cage are at least partly enclosed in casing means provided with openings for the inlet and discharge of air, said cylindrical cage being supported in said casing means in concentric alignment with the centrifugal impeller by engagement of at least one end of said cage with the walls of said casing means.

3. An apparatus for heating and delivering air as defined in claim 2, wherein said casing means is in the shape of a blower housing with opposed circular grooves provided in its side walls for insertion therein of the two opposite ends of the cylindrical cage.

4. An apparatus for heating and delivering air as defined in claim 1, wherein said cylindrical cage is formed from an electric resistance alloy sheet and said guide vanes are in the shape of uniform strips of a length substantially commensurate with the width of said impeller and curved in a direction perpendicular to their long axis, said guide vanes being held in a predetermined angle of incidence by conductive bridging pieces jointing the alternate ends of each two proximate vanes of the cage, so as to form a resistor circuit in zigzag pattern, said means for electrically energizing said guide vanes comprising at least two terminals being provided on the heating element for supplying electric current to the resistor circuit.

5. An apparatus for heating and delivering air as defined in claim 4, wherein said bridging pieces and said guide vanes are integrally formed from a single sheet of resistance alloy material.

6. An appratus apparatus for heating and delivering air, as defined in claim 1, wherein said means for electrically energizing said guide vanes comprises at least three electric terminals spaced over the circumference of the cylindrical cage.

* * * * *